US011118447B2

(12) United States Patent
Chau et al.

(10) Patent No.: US 11,118,447 B2
(45) **Date of Patent: *Sep. 14, 2021**

(54) DIRECTIONAL DRILLING COMMUNICATION PROTOCOLS, APPARATUS AND METHODS

(71) Applicant: Merlin Technology, Inc., Kent, WA (US)

(72) Inventors: Albert W. Chau, Woodinville, WA (US); Loc Viet Lam, Renton, WA (US); Scott Phillips, Kent, WA (US)

(73) Assignee: Merlin Technology, Inc., Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/298,988

(22) Filed: Mar. 11, 2019

(65) Prior Publication Data

US 2019/0203590 A1 Jul. 4, 2019

Related U.S. Application Data

(63) Continuation of application No. 14/208,470, filed on Mar. 13, 2014, now Pat. No. 10,227,867.

(Continued)

(51) Int. Cl.

| | |
|---|---|
| ***E21B 47/13*** | (2012.01) |
| ***E21B 7/04*** | (2006.01) |
| ***E21B 47/024*** | (2006.01) |

(52) U.S. Cl.

CPC ..... *E21B 47/13* (2020.05); *E21B 7/046* (2013.01); *E21B 47/024* (2013.01)

(58) Field of Classification Search

CPC ..... E21B 47/122; E21B 47/024; E21B 7/046; E21B 47/13; E21B 47/12

(Continued)

(56) References Cited

U.S. PATENT DOCUMENTS

| | | | |
|---|---|---|---|
| 4,873,522 | A | 10/1989 | Jurgens |
| 4,945,533 | A | 7/1990 | Schroeder |

(Continued)

FOREIGN PATENT DOCUMENTS

| | | | |
|---|---|---|---|
| EA | 200500372 | A1 | 8/2005 |
| RU | 22376 | U1 | 3/2002 |

(Continued)

OTHER PUBLICATIONS

Notice of Allowance of The State Intellectual Property Office of People's Republic of China for Chinese Application No. 201480014999.3 which is associated with International Application No. PCT/US2014/026819 which is associated with U.S. Appl. No. 14/208,470, dated Sep. 11, 2017. (English translation included).

(Continued)

*Primary Examiner* — Brian Wilson

(74) *Attorney, Agent, or Firm* — Pritzkau Patent Group LLC

(57) ABSTRACT

A transmitter is carried proximate to an inground tool for sensing a plurality of operational parameters relating to the inground tool. The transmitter customizes a data signal to characterize one or more of the operational parameters for transmission from the inground tool based on the operational status of the inground tool. A receiver receives the data signal and recovers the operational parameters. Advanced data protocols are described. Pitch averaging and enhancement of dynamic pitch range for accelerometer readings are described based on monitoring mechanical shock and vibration of the inground tool.

14 Claims, 6 Drawing Sheets

Related U.S. Application Data

(60) Provisional application No. 61/785,410, filed on Mar. 14, 2013.

(58) Field of Classification Search
USPC ..... 340/853.1–856.4
See application file for complete search history.

(56) References Cited

U.S. PATENT DOCUMENTS

| | | | | |
|---|---|---|---|---|
| 5,880,680 | A | 3/1999 | Wisehart | |
| 5,904,210 | A | 5/1999 | Stump | |
| 6,005,532 | A | 12/1999 | Ng | |
| 6,079,506 | A | 6/2000 | Mercer | |
| 6,496,008 | B1 | 12/2002 | Brune et al. | |
| 6,727,704 | B2 | 4/2004 | Brune et al. | |
| 6,737,867 | B2 | 5/2004 | Brune et al. | |
| 6,756,783 | B2 | 6/2004 | Brune et al. | |
| 6,854,535 | B1 | 2/2005 | Mizuno | |
| 7,111,693 | B1 | 9/2006 | Self | |
| 7,150,329 | B2 | 12/2006 | Chau | |
| 7,324,010 | B2 * | 1/2008 | Gardner | E21B 47/16 166/250.15 |
| 7,331,409 | B2 | 2/2008 | Cole et al. | |
| 7,624,816 | B2 | 12/2009 | Cole et al. | |
| 7,975,392 | B1 | 7/2011 | Spaulding | |
| 8,547,428 | B1 | 10/2013 | Olsson et al. | |
| 8,588,192 | B2 | 11/2013 | Padmanabh et al. | |
| 2001/0015698 | A1 | 8/2001 | Tokoro | |
| 2001/0022239 | A1 | 9/2001 | Brune et al. | |
| 2002/0020561 | A1 | 2/2002 | Alft | |
| 2002/0105331 | A1 | 8/2002 | Brune et al. | |
| 2004/0134686 | A1 * | 7/2004 | Burrows | E21B 7/10 175/45 |
| 2005/0115706 | A1 | 6/2005 | Cole et al. | |
| 2005/0284221 | A1 | 12/2005 | Danisch | |
| 2007/0044536 | A1 | 3/2007 | Gunsaulis et al. | |
| 2007/0247329 | A1 | 10/2007 | Petrovic | |
| 2007/0278008 | A1 * | 12/2007 | Kuckes | E21B 47/024 175/40 |
| 2008/0121430 | A1 | 5/2008 | Cole et al. | |
| 2009/0115625 | A1 | 5/2009 | Young | |
| 2009/0120689 | A1 | 5/2009 | Zaeper | |
| 2009/0225811 | A1 | 9/2009 | Albert | |
| 2009/0267790 | A1 | 10/2009 | Hall | |
| 2011/0001633 | A1 * | 1/2011 | Lam | G01V 3/15 340/853.1 |
| 2011/0187546 | A1 | 8/2011 | Liberman | |
| 2012/0166089 | A1 * | 6/2012 | Ramshaw | E21B 47/00 702/12 |
| 2012/0218863 | A1 | 8/2012 | Chau et al. | |
| 2013/0176137 | A1 | 7/2013 | Kolpack | |
| 2013/0176139 | A1 | 7/2013 | Chau et al. | |
| 2014/0210606 | A1 | 7/2014 | Katiba et al. | |
| 2015/0049585 | A1 * | 2/2015 | Collins | G01V 1/50 367/35 |
| 2016/0003035 | A1 | 1/2016 | Logan | |

FOREIGN PATENT DOCUMENTS

| | | |
|---|---|---|
| RU | 2235830 C1 | 9/2004 |
| WO | 2004/076799 | 9/2004 |

OTHER PUBLICATIONS

The International Search Report and The Written Opinion of the International Searching Authority for International Application No. PCT/2014/026819 which is associated with U.S. Appl. No. 14/208,470, dated Aug. 7, 2014, Moscow, Russia.

Written Opinion of the International Preliminary Examining Authority for International Application No. PCT/US 2014/026819 which is associated with U.S. Appl. No. 14/208,470, dated Apr. 17, 2015, Moscow, Russia.

The First Office Action of The State Intellectual Property Office of People's Republic of China for Chinese Application No. 201480014999.3 which is associated with International Application No. PCT/US2014/026819 which is associated with U.S. Appl. No. 14/208,470, dated Jul. 7, 2016. (machine translation included).

The Second Office Action of The State Intellectual Property Office of People's Republic of China for Chinese Application No. 201480014999.3 which is associated with International Application No. PCT/US2014/026819 which is associated with U.S. Appl. No. 14/208,470, dated Feb. 21, 2017. (translation included).

Extended European Search Report for European Application No. 14769021.8 which is associated with International Application No. PCT/US2014/026819 which is associated with U.S. Appl. No. 14/208,470, dated Oct. 14, 2016, Munich, Germany.

The First Office Action of The Russian Federation for Russian Application No. 2015138128 which is associated with International Application No. PCT/US2014/026819 which is associated with U.S. Appl. No. 14/208,470, dated May 11, 2017. (translation included).

The Third Office Action of The State Intellectual Property Office of People's Republic of China for Chinese Application No. 201480014999.3 which is associated with International Application No. PCT/US2014/026819 which is associated with U.S. Appl. No. 14/208,470, dated Jun. 6, 2017. (Google and Global Dossier translations included).

Machine translation of previously cited reference: The First Office Action of The Russian Federation for Russian Application No. 2015138128 which is associated with International Application No. PCT/US2014/026819 which is associated with U.S. Appl. No. 14/208,470, dated May 11, 2017.

Third Office Action of the State Intellectual Property Office of People's Republic of China for Chinese Application No. 201480014999.3 which is associated with International Application No. PCT/US2014/026819 which is associated with U.S. Appl. No. 14/208,470, dated Jun. 6, 2017. (Global Dossier and Google translations included).

Office Action of the European Application No. 14769021.8 which is associated with International Application No. PCT/US2014/026819 which is associated with U.S. Appl. No. 14/208,470, dated Apr. 29, 2021, Munich, Germany.

* cited by examiner

DIRECTIONAL DRILLING COMMUNICATION PROTOCOLS, APPARATUS AND METHODS

RELATED APPLICATIONS

The present application claims priority from U.S. patent application Ser. No. 14/208,470, filed on Mar. 13, 2014, which claims priority from U.S. Provisional Patent Application No. 61/785,410, filed on Mar. 14, 2013, the contents of all of which are hereby incorporated by reference.

BACKGROUND

The present invention is generally related to the field of directional drilling and, more particularly, to advanced directional drilling communication protocols, apparatus and methods.

A technique that is often referred to as horizontal directional drilling (HDD) can be used for purposes of installing a utility without the need to dig a trench. A typical utility installation involves the use of a drill rig having a drill string that supports a boring tool at a distal or inground end of the drill string. The drill rig forces the boring tool through the ground by applying a thrust force to the drill string. The boring tool is steered during the extension of the drill string to form a pilot bore. Upon completion of the pilot bore, the distal end of the drill string is attached to a pullback apparatus which is, in turn, attached to a leading end of the utility. The pullback apparatus and utility are then pulled through the pilot bore via retraction of the drill string to complete the installation. In some cases, the pullback apparatus can comprise a back reaming tool which serves to expand the diameter of the pilot bore ahead of the utility so that the installed utility can be of a greater diameter than the original diameter of the pilot bore.

Steering of a boring tool can be accomplished in a well-known manner by orienting an asymmetric face of the boring tool for deflection in a desired direction in the ground responsive to forward movement. In order to control this steering, it is desirable to monitor the orientation of the boring tool based on sensor readings obtained by sensors that form part of an electronics package that is supported by the boring tool. The sensor readings, for example, can be modulated onto a locating signal that is transmitted by the electronics package for reception above ground by a portable locator or other suitable above ground device. In some systems, the electronics package can couple a carrier signal modulated by the sensor readings onto the drill string to then transmit the signal to the drill rig by using the drill string as an electrical conductor. Irrespective of the manner of transmission of the sensor data and for a given amount of transmission power, there is a limited transmission range at which the sensor data can be recovered with sufficient accuracy. The transmission range can be still further limited by factors such as, for example, electromagnetic interference that is present in the operational region. One prior art approach, in attempting to increase transmission range, is simply to increase the transmission power. Applicants recognize, however, that this approach can be of limited value, particularly when the inground electronics package is powered by batteries, as will be further discussed below. Another approach resides in lowering the data or baud rate at which data is modulated onto the locating signal. Unfortunately, this approach is attended by a drop in data throughput.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect of the disclosure, an apparatus and associated method are described for use in conjunction with a system for performing an inground operation in which a drill string extends from a drill rig to an inground tool such that extension and retraction of the drill string generally produces corresponding movements of the inground tool during the inground operation. A transmitter is configured to be carried proximate to the inground tool for sensing a plurality of operational parameters relating to the inground tool and for customizing a data signal to characterize one or more of the operational parameters for transmission from the inground tool based on an operational status of the inground tool. A receiver is positionable at an aboveground location for receiving the data signal and for recovering the operational parameters.

In another aspect of the disclosure, a transmitter and an associated method are described for use in conjunction with a receiver as part of a system for performing an inground operation in which a drill string extends from a drill rig to an inground tool which supports the transmitter such that extension and retraction of the drill string generally produces corresponding movements of the inground tool during the inground operation. The transmitter includes at least one sensor for sensing one or more operational parameters relating to an operational status of the inground tool and a processor configured for customizing a data signal for transmission from the transmitter based on the operational status of the inground tool.

In still another aspect of the disclosure a receiver and associated method are described for use in conjunction with a transmitter as part of a system for performing an inground operation in which a drill string extends from a drill rig to an inground tool which supports a transmitter such that extension and retraction of the drill string generally produces corresponding movements of the inground tool during the inground operation. The receiver is configured for receiving a data signal that is transmitted by the transmitter and which data signal characterizes one or more operational parameters relating to an operational status of the inground tool such that the data signal is customized based on the operational status. A processor is configured for decoding the customized data signal to recover the one or more operational parameters.

In yet another aspect of the present disclosure, a transmitter and associated method are described for use in conjunction with a system for performing an inground operation in which a drill string extends from a drill rig to an inground tool such that extension and/or rotation of the drill string provides for moving the inground tool along an inground path while subjecting the inground tool to mechanical shock and vibration. An accelerometer, as part of the transmitter, senses a pitch orientation of the inground tool in each of a high resolution range and a low resolution range subject to the mechanical shock and vibration to produce a series of pitch readings. A processor is configured for monitoring the series of pitch readings and, responsive thereto, for selecting one of the high resolution range and the low resolution range for characterizing the pitch orientation and for averaging the series of pitch readings in the selected one of the high resolution range and the low resolution range to generate an average pitch reading for transmission from the transmitter.

In a continuing aspect of the present disclosure, a transmitter and associated method are described for use in conjunction with a system for performing an inground operation in which a drill string extends from a drill rig to an inground tool such that extension and/or rotation of the drill string provides for moving the inground tool along an inground path while subjecting the inground tool to mechanical shock and vibration. An accelerometer forms part of the transmitter for sensing a pitch orientation of the inground tool to produce a series of pitch readings. A processor is configured for averaging the series of pitch readings to generate an average pitch reading for transmission from the transmitter.

In a further aspect of the present disclosure, it is recognized that advanced data protocols can be selectively utilized, for example, to enhance update rates for one or more parameters that are used in relation to monitoring an inground tool. These advanced data protocols can provide for dramatic reductions in the amount of data that is needed to effectively characterize a given parameter, for example, based on changing the resolution of the parameter such that fewer data bits are needed. By way of non-limiting example, a transmitter and associated method are described for use in conjunction with a receiver as part of a system for performing an inground operation in which a drill string extends from a drill rig to an inground tool which supports the transmitter such that extension and retraction of the drill string generally produces corresponding movements of the inground tool during the inground operation. At least one sensor forms part of the transmitter for sensing one or more operational parameters relating to the inground tool. A processor is configured for transmitting data relating to the one or more operational parameters in a standard mode and in an alternative mode, such that the alternative mode characterizes at least a particular one of the operational parameters using a number of bits that is less than the number of bits that the particular parameter is characterized by in the standard mode with the alternative mode representing the particular parameter at a lower resolution than the standard mode.

In another aspect of the present disclosure, a transmitter and associated method are described for use in conjunction with a receiver as part of a system for performing an inground operation in which a drill string extends from a drill rig to an inground tool which supports the transmitter such that extension and retraction of the drill string generally produces corresponding movements of the inground tool during the inground operation. At least one sensor forms part of the transmitter for sensing one or more operational parameters relating to the inground tool. A processor is configured for transmission of a data signal from the transmitter using a plurality of packet communication protocols including a particular protocol that, responsive to detecting a stationary state of the transmitter, utilizes a fixed data frame to characterize the one or more operational parameters and repeatedly transmits the fixed data frame.

BRIEF DESCRIPTIONS OF THE DRAWINGS

Exemplary embodiments are illustrated in referenced figures of the drawings. It is intended that the embodiments and figures disclosed herein are to be illustrative rather than limiting.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents. It is noted that the drawings are not to scale and are diagrammatic in nature in a way that is thought to best illustrate features of interest. Descriptive terminology may be adopted for purposes of enhancing the reader's understanding, with respect to the various views provided in the figures, and is in no way intended as being limiting.

Figure 1:
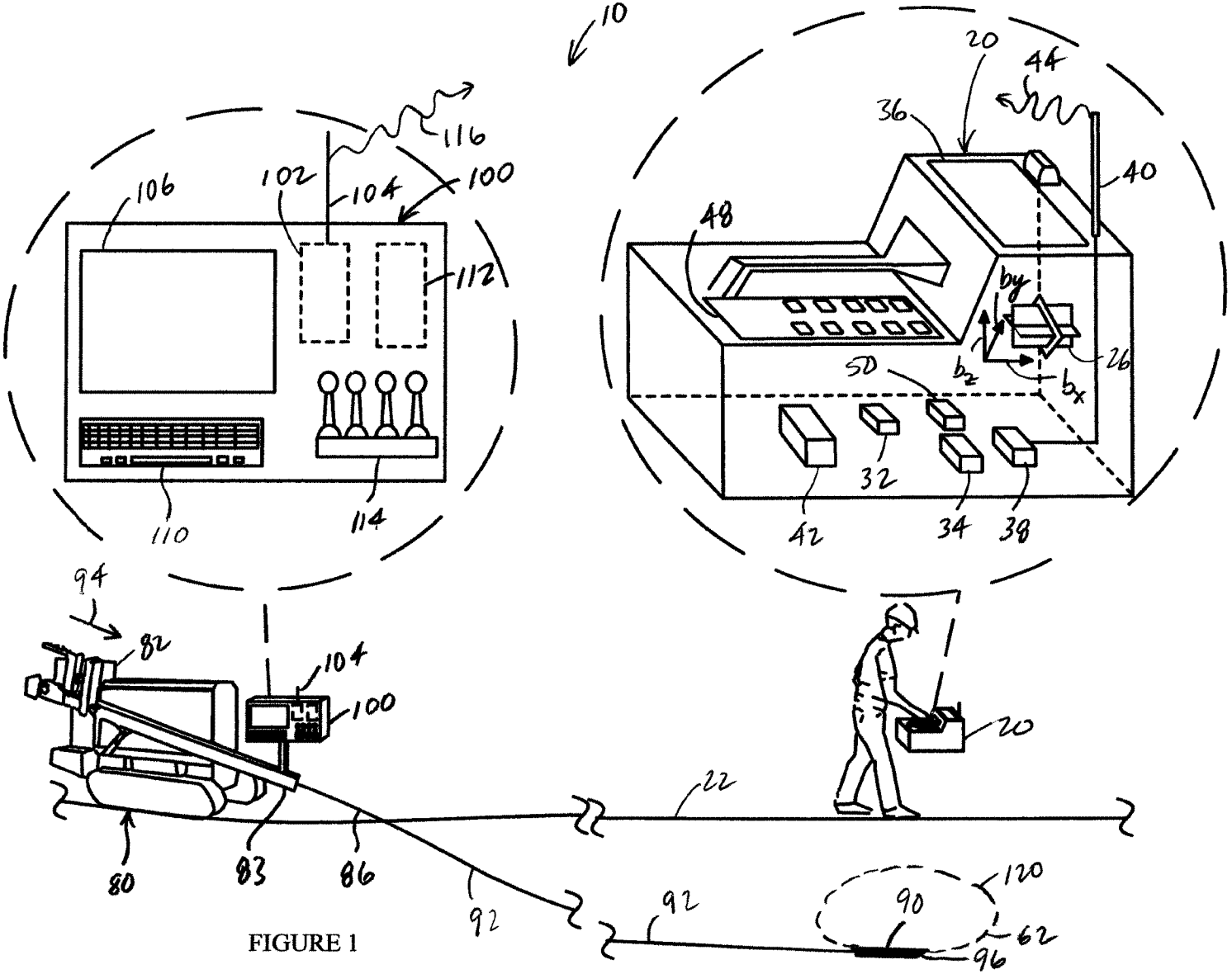
FIG. 1 is a diagrammatic view, in elevation, of an embodiment of a system for performing an inground operation which utilizes advanced communication protocols between an inground transmitter and a portable device in accordance with the present disclosure.

Turning now to the drawings, wherein like items may be indicated by like reference numbers throughout the various figures, attention is immediately directed to FIG. 1, which illustrates one embodiment of a system for performing an inground operation, generally indicated by the reference number 10. The system includes a portable device 20 that is shown being held by an operator above a surface 22 of the ground as well as in a further enlarged inset view. It is noted that inter-component cabling within device 20 has not been illustrated in order to maintain illustrative clarity, but is understood to be present and may readily be implemented by one having ordinary skill in the art in view of this overall disclosure. Device 20 includes a three-axis antenna cluster 26 measuring three orthogonally arranged components of magnetic flux indicated as $b_x$, $b_y$ and $b_z$. One useful antenna cluster contemplated for use herein is disclosed by U.S. Pat. No. 6,005,532 which is commonly owned with the present application and is incorporated herein by reference. Antenna cluster 26 is electrically connected to a receiver section 32. A tilt sensor arrangement 34 may be provided for measuring gravitational angles from which the components of flux in a level coordinate system may be determined.

Device 20 can further include a graphics display 36, a telemetry arrangement 38 having an antenna 40 and a processing section 42 interconnected appropriately with the various components. The telemetry arrangement can transmit a telemetry signal 44 for reception at the drill rig. The processing section can include a digital signal processor (DSP) that is configured to execute various procedures that are needed during operation. It should be appreciated that graphics display 36 can be a touch screen in order to facilitate operator selection of various buttons that are defined on the screen and/or scrolling can be facilitated between various buttons that are defined on the screen to provide for operator selection. Such a touch screen can be used alone or in combination with an input device 48 such as, for example, a keypad. The latter can be used without the need for a touch screen. Moreover, many variations of the input device may be employed and can use scroll wheels and other suitable well-known forms of selection device. The processing section can include components such as, for example, one or more processors, memory of any appropriate type and analog to digital converters. As is well known in the art, the latter should be capable of detecting a frequency that is at least twice the frequency of the highest frequency of interest. Other components may be added as desired such as, for example, a magnetometer 50 to aid in position determination relative to the drill direction and ultrasonic transducers for measuring the height of the device above the surface of the ground.

Still referring to FIG. 1, system 10 further includes drill rig 80 having a carriage 82 received for movement along the length of an opposing pair of rails 83. An inground tool 90 is attached at an opposing end of a drill string 92. By way of non-limiting example, a boring tool is shown as the inground tool and is used as a framework for the present descriptions, however, it is to be understood that any suitable inground device may be used such as, for example, a reaming tool for use during a pullback operation or a mapping tool. Generally, drill string 92 is made up of a plurality of removably attachable drill pipe sections such that the drill rig can force the drill string into the ground using movement in the direction of an arrow 94 and retract the drill string responsive to an opposite movement. The drill pipe sections can define a through passage for purposes of carrying a drilling mud or fluid that is emitted from the boring tool under pressure to assist in cutting through the ground as well as cooling the drill head. Generally, the drilling mud also serves to suspend and carry out cuttings to the surface along the exterior length of the drill string. Steering can be accomplished in a well-known manner by orienting an asymmetric face 96 of the boring tool for deflection in a desired direction in the ground responsive to forward, push movement which can be referred to as a "push mode." Rotation or spinning of the drill string by the drill rig will generally result in forward or straight advance of the boring tool which can be referred to as a "spin" or "advance" mode.

The drilling operation is controlled by an operator (not shown) at a control console 100 (best seen in the enlarged inset view) which itself includes a telemetry transceiver 102 connected with a telemetry antenna 104, a display screen 106, an input device such as a keyboard 110, a processing arrangement 112 which can include suitable interfaces and memory as well as one or more processors. A plurality of control levers 114, for example, control movement of carriage 82. Telemetry transceiver 104 can transmit a telemetry signal 116 to facilitate bidirectional communication with portable device 20. In an embodiment, screen 106 can be a touch screen such that keyboard 110 may be optional.

Device 20 is configured for receiving an electromagnetic locating signal 120 that is transmitted from the boring tool or other inground tool. The locating signal can be a dipole signal. In this instance, the portable device can correspond, for example, to the portable device described in any of U.S. Pat. Nos. 6,496,008, 6,737,867, 6,727,704, as well as U.S. Published Patent Application no. 2011-0001633 each of which is incorporated herein by reference. In view of these patents, it will be appreciated that the portable device can be operated in either a walkover locating mode, as illustrated by FIG. 1, or in a homing mode having the portable device placed on the ground, as illustrated by the U.S. Pat. No. 6,727,704. While the present disclosure illustrates a dipole locating field transmitted from the boring tool and rotated about the axis of symmetry of the field, the present disclosure is not intended as being limiting in that regard.

Locating signal 120 can be modulated with information generated in the boring tool including, but not limited to position orientation parameters based on pitch and roll orientation sensor readings, temperature values, pressure values, battery status, tension readings in the context of a pullback operation, and the like. Device 20 receives signal 120 using antenna array 26 and processes the received signal to recover the data. It is noted that, as an alternative to modulating the locating signal, the subject information can be carried up the drill string to the drill rig using electrical conduction such as a wire-in-pipe arrangement. In another embodiment, bi-directional data transmission can be accomplished by using the drill string itself as an electrical conductor. An advanced embodiment of such a system is described in commonly owned U.S. application Ser. No. 13/733,097, published as U.S. Published Application no. 2013/0176139, and which is incorporated herein by reference in its entirety. In either case, all information can be made available to console 100 at the drill rig.

Figure 2:
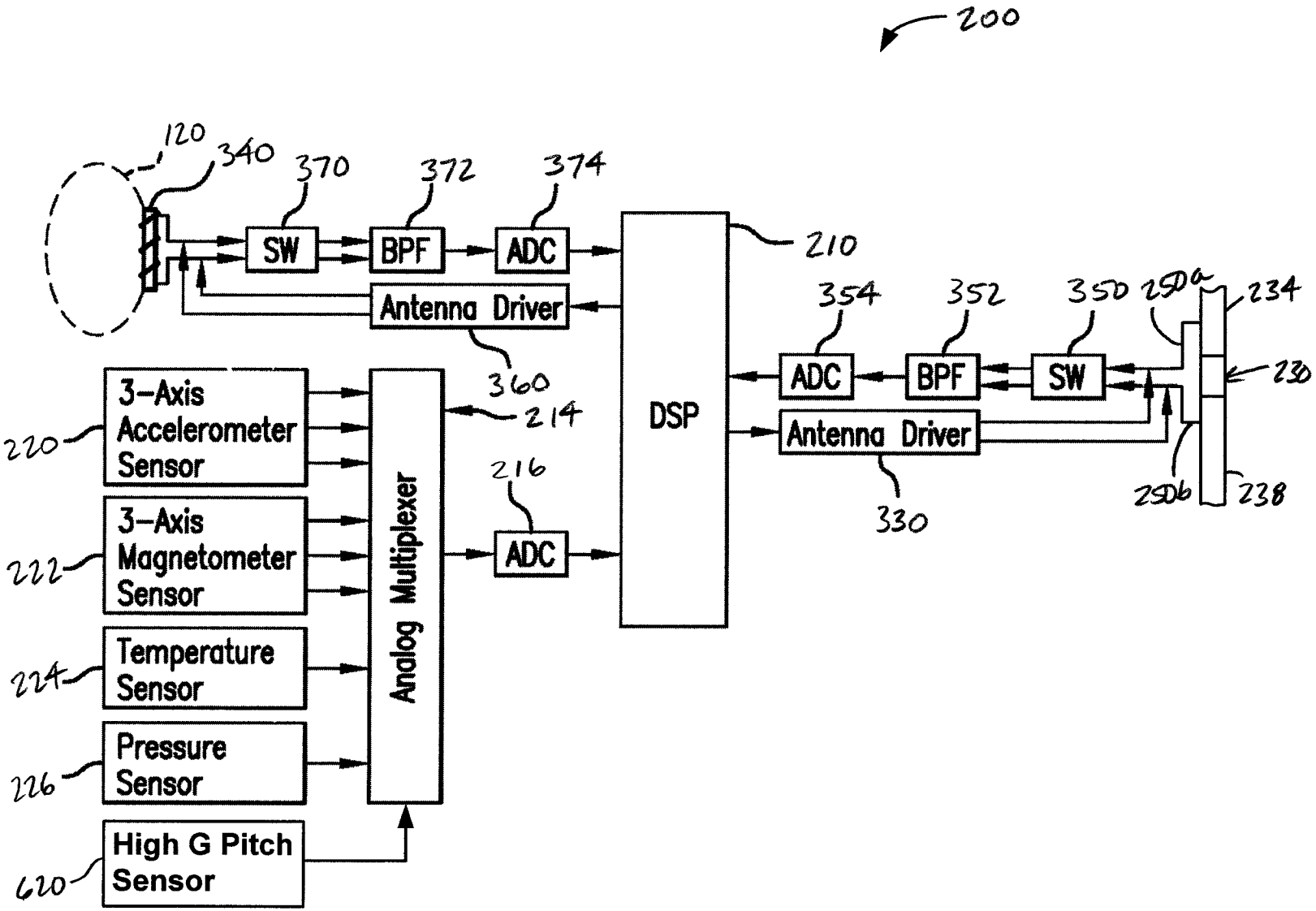
FIG. 2 is a block diagram which illustrates an embodiment of an electronics package that can be carried by an inground tool and implemented in accordance with the present disclosure.

FIG. 2 is a block diagram which illustrates an embodiment of an electronics package, generally indicated by the reference number 200, which can be supported by boring tool 90. The electronics package can include an inground digital signal processor 210. A sensor section 214 can be electrically connected to digital signal processor 210 via an analog to digital converter (ADC) 216. Any suitable combination of sensors can be provided for a given application and can be selected, for example, from an accelerometer 220, a magnetometer 222, a temperature sensor 224 and a pressure sensor 226 which can sense the pressure of drilling fluid prior to being emitted from the drill string and/or within the annular region surrounding the downhole portion of the drill string. In an embodiment which implements communication to the drill rig via the use of the drill string as an electrical conductor, an isolator 230 forms an electrically isolating connection in the drill string and is diagrammatically shown as separating an uphole portion 234 of the drill string from a downhole portion 238 of the drill string for use in one or both of a transmit mode, in which data is coupled onto the drill string, and a receive mode in which data is recovered from the drill string. In some embodiments, the electrical isolation can be provided as part of the inground tool. The electronics section can be connected, as illustrated, across the electrically insulating/isolating break formed by the isolator by a first lead 250*a* and a second lead 250*b* which can be referred to collectively by the reference number 250. For the transmit mode, an antenna driver section 330 is used which is electrically connected between inground digital signal processor 210 and leads 250 to directly drive the drill string. Generally, the data that can be coupled into the drill string can be modulated using a frequency that is different from any frequency that is used to drive a dipole antenna 340 that can emit afore described signal 120 (FIG. 1) in order to avoid interference. When antenna driver 330 is off, an On/Off Switcher (SW) 350 can selectively connect leads 250 to a band pass filter (BPF) 352 having a center frequency that corresponds to the center frequency of the data signal that is received from the drill string. BPF 352 is, in turn, connected to an analog to digital converter (ADC) 354 which is itself connected to digital signal processing section 210. In an embodiment, a DC blocking anti-aliasing filter can be used in place of a band pass filter. Recovery of the modulated data in the digital signal processing section can be readily configured by one having ordinary skill in the art in view of the particular form of modulation that is employed and in view of this overall disclosure.

Still referring to FIG. 2, dipole antenna 340 can be connected for use in one or both of a transmit mode, in which signal 120 is transmitted into the surrounding earth, and a receive mode in which an electromagnetic signal such as a signal from an inground tool such as, for example, a tension monitor is received. For the transmit mode, an antenna driver section 360 is used which is electrically connected between inground digital signal processor 210 and dipole antenna 340 to drive the antenna. Again, the frequency of signal 120 will generally be sufficiently different from the frequency of the drill string signal to avoid interference therebetween. When antenna driver 360 is off, an On/Off Switcher (SW) 370 can selectively connect dipole antenna 340 to a band pass filter (BPF) 372 having a center frequency that corresponds to the center frequency of the data signal that is received from the dipole antenna. In an embodiment, a DC blocking anti-aliasing filter can be used in place of a band pass filter. BPF 372 is, in turn, connected to an analog to digital converter (ADC) 374 which is itself connected to digital signal processing section 210. Transceiver electronics for the digital signal processing section can be readily configured in many suitable embodiments by one having ordinary skill in the art in view of the particular form or forms of modulation employed and in view of this overall disclosure. The design shown in FIG. 2 can be modified in any suitable manner in view of the teachings that have been brought to light herein.

Referring again to FIG. 1, the range at which locating signal 120 can be received by portable device 20 is based on the inverse cube of the distance. While increasing transmission power from the inground tool increases the range, it should be appreciated that doubling the transmission power results in only a 15% increase in range. Of course, a significant reduction in battery life can be experienced responsive to such a power increase when the transmitter supported in the inground tool is battery powered. Further, the reception range can be influenced to a large measure by local interference. Powerline noise harmonics at (n×50) Hz and (n×60) Hz can represent a significant noise source. In the past, the carrier frequency for locating signal 120 has been carefully selected in order to avoid powerline harmonics. In some cases, avoiding powerline harmonics can require narrowing the bandwidth for data that is modulated onto locating signal 120. Applicants recognize, however, that narrowing the data bandwidth results in lower data throughput. Relatively lower data throughput values can be problematic in terms of achieving sufficiently rapid data updates at the portable device. For example, when the operator is attempting to establish a desired roll orientation of the inground tool for steering purposes, relatively slow roll orientation updates can cause this to be a time-consuming process. In view of the foregoing, it should now be apparent that the avoidance of noise interference and data throughput have been competing interests. Until now, Applicant submits that there has not been an effective solution in view of these competing interests. As will be seen, Applicant has discovered data protocols that are customized in terms of inground operations to make highly efficient use of available data bandwidth. It should be appreciated that these protocols are applicable to transmission via an electromagnetic locating signal or by using the drill string as an electrical conductor. While certain concepts may be described in terms of an electromagnetic signal, such concepts are recognized as being equally applicable with respect to transmission on the drill string.

For purposes of data transmission according to the present disclosure, the data can be encoded on the carrier in any suitable manner such as, for example, phase encoded, amplitude modulated, frequency modulated or any suitable combination thereof. Certain modulation schemes such as, for example, Manchester encoding can be beneficial in terms of maintaining signal energy at the carrier frequency which enhances locating range. On the other hand, other modulation schemes such as, for example, quadrature phase shift keying (QPSK) provide a relatively higher data throughput for a given bandwidth.

Generally, data can be transmitted in digital form on locating signal 120 using a packet structure. Data can be transmitted using packets that are dedicated to specific types of data. For example, different packet structures can be used to transmit roll data, pitch data, battery status, temperature, pressure and the like. The shorter the packet, the less susceptible the packet is to noise corruption when received at portable device 20. Since packets are transmitted to the portable device in a streaming fashion, it is necessary for the portable device to be able to distinguish the beginning of a new packet. Embodiments of packets, that are brought to light herein, can utilize sync bits for this purpose. With these fundamentals in mind, a number of unique packet structures will be described immediately hereinafter.

Table 1 is illustrative of an embodiment of a roll packet in accordance with the present disclosure in the context of Manchester encoding, although the latter is not a requirement. Traditional roll packets, by way of example, can encode 24 roll positions (i.e., 15 degree increments) using additional sync bits that do not contribute to the encoding. Applicant recognizes that the sync bits can be used to contribute to the encoding. At the same time, the number of encoded roll positions can be reduced to decrease the size of the roll packet. For example, Applicant has found that 8 encoded roll positions are sufficient to identify the roll orientation of the boring tool such that only 3 data bits are necessary. Table 1 illustrates the roll packet structure for the 8 roll positions. Each L (Low) and H (High) value represents one half of a bit time in a manner that is consistent with Manchester encoding. Bit 1 of the 3 data bits is represented by sync bit 1 and sync bit 2. In the present embodiment, each sync bit encompasses one and one half bit times. As seen in Table 1, allowed sync interval values encompassed by sync bits 1 and 2 include either 3 bit times low followed by 3 bit times high (Roll 1-4) or 3 bit times high followed by 3 bit times low (Roll 5-8). Thus, sync bit 1 in combination with sync bit 2 can represent data bit 1 and only two additional data bits 2 and 3 are needed to make up the 3 data bits for purposes of encoding the three bit values. Accordingly, any embodiment of a packet can utilize the sync bits in this manner as the most significant bit (MSB). For example, temperature can be encoded as normal, high and very high such that the sync bits and only one data bit are needed for a temperature packet. It should be appreciated that packet transmission can be prioritized. For example, under normal temperature conditions, the temperature packet can be transmitted at a fixed interval such as, for instance, 15 seconds. When a rate of change in the temperature rises above a defined threshold, however, the temperature packet can be transmitted immediately. Such a temperature threshold, by way of non-limiting example, can be an increase of more than 10° C. in 2 seconds. A battery status packet can be encoded, for example, with three data bits in addition to the most significant bit being represented by sync bits 1 and 2.

TABLE 1

ROLL PACKET

| Roll Position | Data Bit 1 | | | | | | | | | |
|---|---|---|---|---|---|---|---|---|---|---|
| | Sync Bit 1 | | | | Sync Bit 2 | | Data Bit 2 | | Data Bit 3 | |
| Roll 1 | L | L | L | H | H | H | H | L | H | L |
| Roll 2 | L | L | L | H | H | H | H | L | L | H |
| Roll 3 | L | L | L | H | H | H | L | H | H | L |
| Roll 4 | L | L | L | H | H | H | L | H | L | H |
| Roll 5 | H | H | H | L | L | L | H | L | H | L |
| Roll 6 | H | H | H | L | L | L | H | L | L | H |
| Roll 7 | H | H | H | L | L | L | L | H | H | L |
| Roll 8 | H | H | H | L | L | L | L | H | L | H |

While roll packets are often targeted for the most rapid updates, pitch packets also are transmitted quite frequently. By way of non-limiting example, one pitch packet can be transmitted for every six roll packets. Traditionally, pitch packets have been lengthy for purposes of defining a high-resolution pitch reading. For example, traditional pitch packets can have a resolution of 0.05° or 0.1% irrespective of the operational status of the boring tool. Applicant recognizes that, when the inground tool is rotating or just moving, shock and vibration can severely limit the accuracy of the pitch reading that is produced by the accelerometers in the sensor suite of the electronics package that is carried by the boring tool. This effect is even further exacerbated when the boring tool is advancing in rocky soil. Based on this recognition, the pitch packet can be dynamically customized in resolution when the boring tool is rotating and/or advancing. One embodiment of dynamic pitch packet resolution ranges is illustrated by Table 2.

TABLE 2

Dynamic Pitch Resolution

| Pitch Range | Number of Data Bits | Pitch Resolution |
|---|---|---|
| +/−16° | 5 | 1° |
| +/−17° to 45° | 6 | 1.5° |

As seen in Table 2, when the inground tool is in motion, the pitch packet can contain five data bits to define a pitch resolution of 1° within a pitch range of +/−16°. If the sync bits are used to signify the (+/−) sign of the pitch, only 4 data bits are needed. On either side of the +/−16° range, from +17° to +45° and from −17° to −45°, six data bits can be used to define a pitch resolution of 1.5°. If the sync bits are used to signify the (+/−) sign of the pitch, only 5 data bits are needed.

It should be appreciated that, at least from a practical standpoint, pitch readings can be limited to (+/−) 45°. High accuracy pitch readings are desirable in certain circumstances such as, for example, gravity sewer line installation. While it is not practical to provide such a high-resolution pitch accuracy while the boring tool is advancing and/or rotating, Applicant recognizes that it is practical to transmit high resolution pitch packets responsive to the boring tool being detected as stationary. Of course, such detection can readily be performed using the accelerometers that are part of the sensor suite of the electronics package in the boring tool. At the same time, Applicants further recognize that pitch packets can be customized to utilize data bits in a highly efficient manner when the boring tool or other inground device is stationary. By way of non-limiting example, pitch resolution can be compressed within the range of +/−11° to provide a high pitch resolution in this range while providing a more relaxed resolution outside of this range (i.e., when the pitch angle exceeds 11°). In this regard, most gravity sewer line installations are limited to the range of +/−5% grade which corresponds to approximately +/−2.86°. This stationary pitch resolution embodiment is illustrated by Table 3 including the number of values within four different pitch ranges for the specified pitch resolutions. A total of 509 values is needed such that a pitch packet having 9 data bits can be used to cover all four of the delineated pitch ranges. Again, if the sync bits are used for the sign, only 8 data bits are needed.

TABLE 3

Stationary/Static Pitch Resolution

| Pitch Range in Degrees | Number of Values in Range | Pitch Resolution |
|---|---|---|
| +/−11 | 441 | 0.05° |
| +12 to +20, −12 to −20 | 36 | 0.5° |
| +21 to +27, −21 to −27 | 14 | 1° |
| +28 to +44, −28 to −44 | 18 | 2° |

It should be appreciated that the stationary pitch resolution ranges of Table 3 are provided by way of example and are not intended as being limiting but as demonstrative of pitch resolution ranges that progress in a nonlinear manner for purposes of limiting the number of data bits that are needed in a pitch packet. Through the teachings that have been brought to light herein, dramatic reductions in packet sizes can be achieved, for example, on the order of 1/2 (i.e., a factor of 2) which translates into significantly increased update rates for purposes of monitoring the inground tool while utilizing a narrow data bandwidth that provides ample noise immunity.

Figure 3:
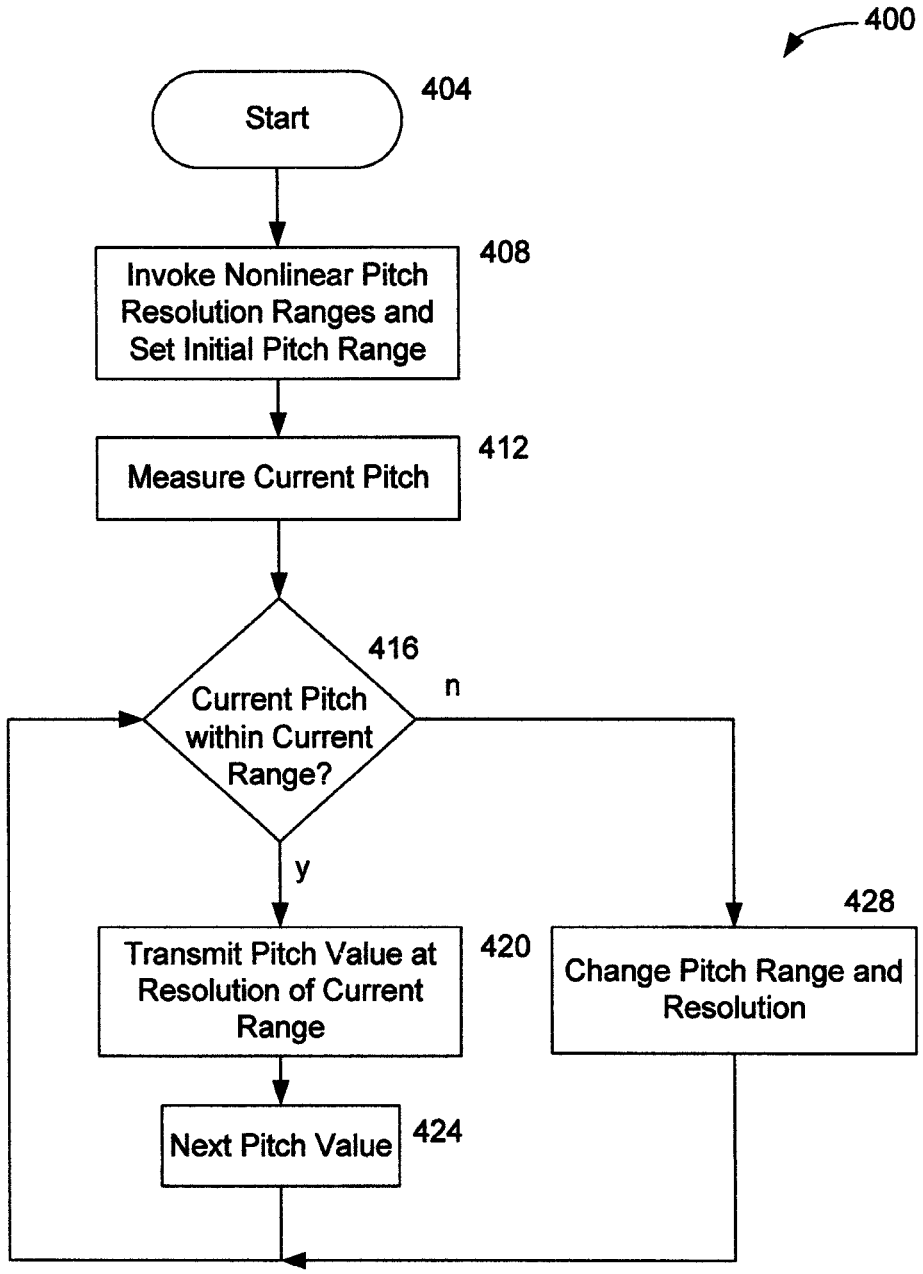
FIG. 3 is a flow diagram illustrating an embodiment of a method for monitoring pitch of an inground tool and applying a nonlinear pitch range distribution.

FIG. 3 is a flow diagram illustrating one embodiment of a method, generally indicated by the reference number 400, for monitoring pitch and applying a nonlinear pitch range distribution, for example, according to either of Tables 2 and 3. The method begins at 404 and proceeds to 408 which invokes the nonlinear pitch resolution ranges of interest and sets an initial one of the ranges as a starting point. At 412, the current pitch value is measured as an input for step 416. The latter determines whether the current pitch is within the currently specified pitch range. If so, step 420 transmits the current pitch value at the resolution of the currently specified pitch range. The next pitch value is then obtained at 424. If step 416 detects that the current pitch reading is not within the currently specified pitch range, operation proceeds to 428 which sets the proper pitch range in accordance with the current pitch reading. Operation then returns to step 416.

Figure 4:
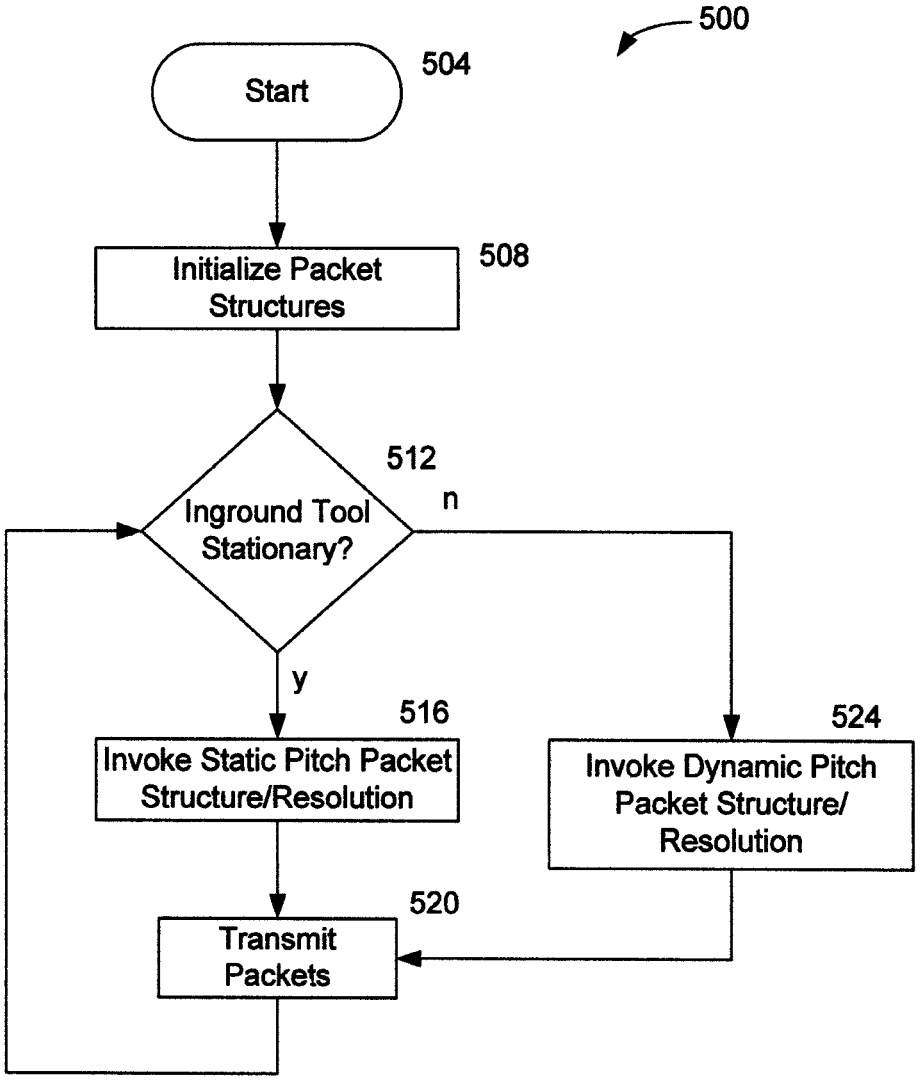
FIG. 4 is a flow diagram illustrating an embodiment of a method for customizing a packet structure for transmission of packets from an inground tool based on the operational condition or status of an inground tool.

Attention is now directed to FIG. 4 which is a flow diagram illustrating one embodiment of a method, generally indicated by the reference number 500, for changing packet structures based on the operational condition of the inground tool. The method begins at start 504 and proceeds to 508 which initializes the packet structures to be used in the process. In an embodiment, the initialization can be based, for example, on the pitch orientation of the transmitter at start-up. In another embodiment, the initialization can be based on interference in the operational region such that the advanced packet protocols described herein, with higher noise/interference immunity, can be used. Local interference, for example, can be detected in any suitable manner including in accordance with the above incorporated U.S. 2011-0001633 Application and/or as described in U.S. Published Application no. 2013/0176139 which is commonly owned with the present application and hereby incorporated by reference. For example, the 2013/0176139 Application teaches that sufficient degradation of the locating signal can be detected based on an inability to decode roll orientation information, pitch orientation information and/or other status information. Further, the bit error rate (BER) of the locating signal can be monitored in relation to an acceptable threshold. At 512, the operational status of the inground tool is determined, for example, by monitoring accelerometer outputs for a brief period of time. If the inground tool is stationary, no transitory acceleration should be detected. If the inground tool is detected to be stationary, operation proceeds to 516 which applies a static pitch packet structure or resolution to pitch packets that are be transmitted, for example, in accordance with Table 3. The pitch packets are then transmitted at 520. If, on the other hand, step 512 determines that the inground tool is not stationary, operation proceeds to 524 which applies a dynamic pitch packet structure and resolution, for example, in accordance with Table 2.

In another embodiment, when the inground tool is detected as being stationary, the signals from the various orientation sensors (accelerometers) should be stable and unchanging. Under these conditions, the electronics package can switch to a fixed length packet or data frame that contains any desired collection of data such as, for example, the roll orientation, pitch orientation, battery status and temperature. The fixed length data frame can be repeatedly transmitted during the stationary state of the boring tool to allow the application of ensemble averaging to achieve the overall effect of increasing the signal strength by adding up successive data frames, while the random noise will sum to zero mean. In this regard, if n is the number of samples and the noise is random, the signal to noise ratio increases as the square root of n. In other words, the greater the number of data frames that are added, the higher the effective signal to noise ratio becomes. The results are enhanced with increasing stability of the clocks in electronics package 200 and device 20. A phase locked loop can be employed by device 20 to further enhance stability by phase locking to the carrier of the locating signal. By way of non-limiting example, a fixed data frame can be represented as SSSRRRRRPPPPPPPPPPPPBBTT where S represents a sync bit, R denotes a roll data bit, P denotes a pitch data bit, B denotes a battery status data bit and T denotes a temperature status bit. A data buffer in device 20 can receive the repetitive transmission and may store the frame, for example, as PPPBBTTSSSRRRRRPPPPPPPP. As additional frames are accumulated, for example, in a high interference area, the portable device will continue to search for the sync bits and ultimately locate the sync bits as part of decoding the frame. Of course, the data can be buffered at the drill rig or any other suitable location for decoding purposes. It is noted that averaging 4 packets or frames has the effect of reducing noise by a factor of 2. The foregoing example uses 5 bits for roll (32 values for 24 clock positions) and 11 bits for pitch to cover +/−45° or +/−100% grade at 0.1% resolution. As described above and set forth in Table 3, a nonlinear pitch encoding can reduce the number of bits required to cover the +/−45° range using fewer data bits, for example, using 9 data bits, as opposed to 11 bits.

In still another embodiment, when step 512 detects that the inground tool is not rotating and/or stationary, the transmission of roll packets can be suspended as part of an overall static packet structure. Transmission of roll packets can resume responsive to detecting that the inground tool is at least rotating. In some embodiments, advance of the inground tool can then be inhibited until roll packets are being received during rotation.

Figure 5:
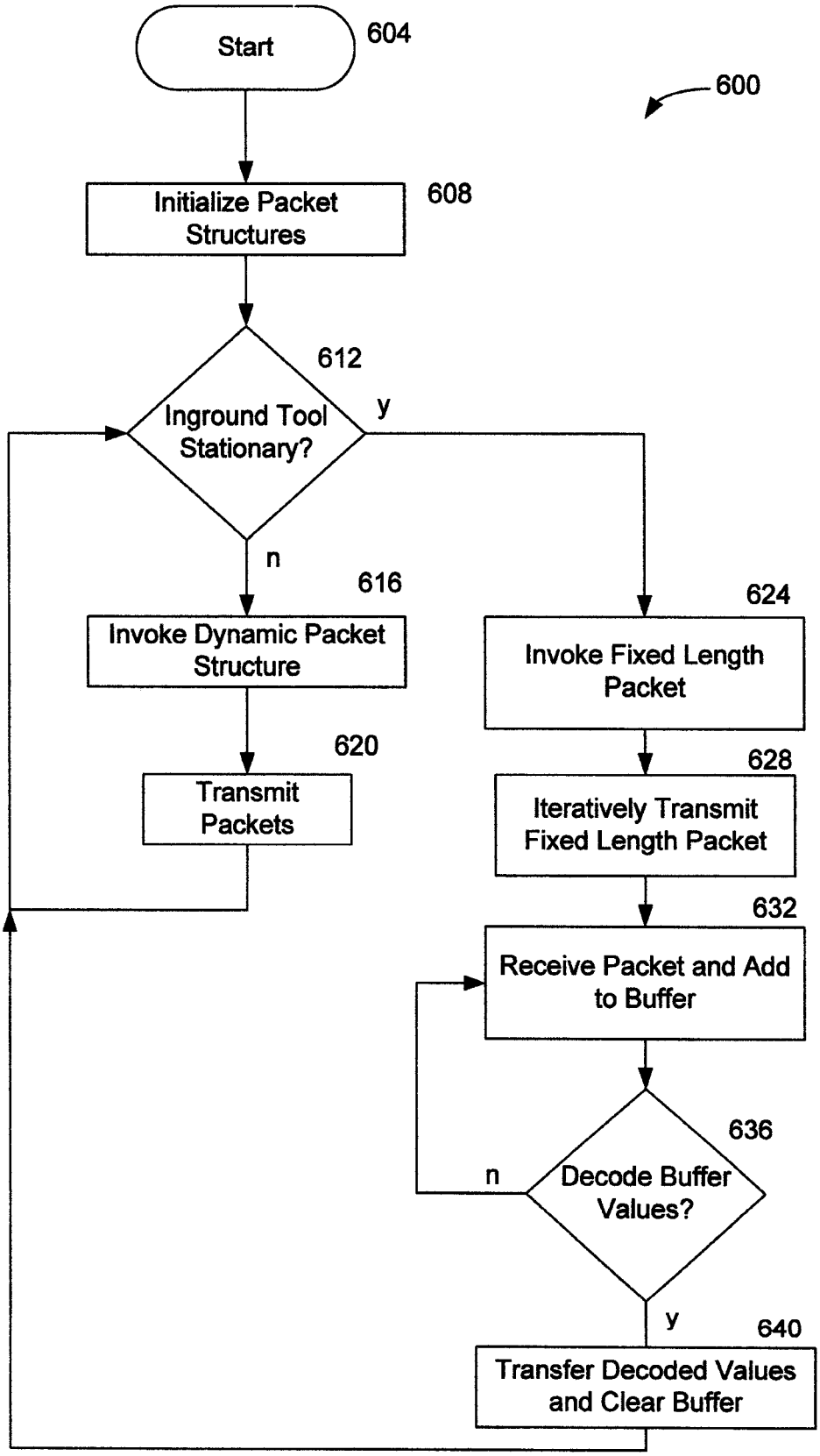
FIG. 5 is a flow diagram illustrating an embodiment of a method for dynamically invoking a fixed packet length for ensemble averaging responsive to the operational state of an inground tool.

Attention is now directed to FIG. 5 which is a flow diagram illustrating one embodiment of a method, generally indicated by the reference number 600, for dynamically invoking a fixed packet length for ensemble averaging responsive to the operational state of the inground tool. The method begins at 604 and proceeds to 608 which initializes the various packet structures that are to be employed based on the operational status of the ground tool. For example, when the inground tool is moving, roll orientation can be specified using 8 roll positions in accordance with Table 1 while pitch orientation can be specified, for example, in accordance with Table 2. A fixed length packet structure can be employed when the inground tool is not moving, for example, consistent with the descriptions immediately above. Operation then moves to 612 which determines the operational status of the boring tool in terms of being in movement or stationary. As discussed above, in one embodiment, accelerometer outputs can be monitored for a brief period of time for purposes of making this determination. If the boring tool is found to be moving, operation proceeds to 616 which invokes a dynamic packet structure, for example, according to Tables 1 and 2. At 620, packets are transmitted. Operation then returns to 612. When the latter step determines that the inground tool is stationary, operation proceeds to 624 which initiates the fixed length packet structure. At 628, the fixed length packet is repeatedly/iteratively transmitted for reception by the portable device or other appropriate hardware above ground. At 632, the fixed length packet is received and can be added to a buffer in the manner described above. Attempts can be made at 636 to decode the buffer value, for example, on each iteration. In other embodiments, the portable device can delay any attempt at decoding until some predetermined amount of data has been accumulated in the buffer. On each iteration, if decode is unsuccessful, operation returns to step 632 to receive the next packet. Once a successful decode has been achieved, operation proceeds to 640 which transfers the decoded values to the appropriate location and can then clear the buffer. Operation then returns to 612.

As discussed above and with reference to FIG. 2, accelerometers 220 are subject to high levels of shock and vibration. In order to provide a real-time pitch reading while drilling, in an embodiment, processor 210 can apply a continuous filter to raw pitch data to smooth out the shock and vibration induced variations. For example, rate filtering can discard pitch changes faster than +/−3° per second. The +/−3° per second value of the present example is not a requirement, but is derived from the fact that the drill pipe which makes up the drill string exhibits a finite bend radius such that the boring tool housing cannot change pitch or direction without traveling some finite distance. For example, if R is the limiting bend radius of the drill pipe, S is the arc length of the tool travel and theta (θ) is the change in pitch angle:

$$R=S\times\theta \quad \text{(equation 1)}$$

If R=100 ft and θ=3°, S=5.236 ft. Unless the penetration rate is faster than 3.57 mph during steering, the +/−3° per second should be adequate.

In another embodiment, pitch angle can be averaged while drilling by switching to a higher g sensor (i.e., accelerometer) when the inground tool is rotating and/or moving. When drilling in rock, the shock and vibration on the inground tool housing can be several hundred gs. The measurement range of typical MEMS accelerometers that are commonly used in horizontal directional drilling applications are often limited to +/−2 g, due to the need for high resolution. As a result of this limited dynamic range, such an accelerometer can constantly encounter its upper and lower limits, depending on the drilling conditions. Under adverse conditions with limited dynamic range, it is difficult to obtain a meaningful average pitch even by applying averaging to the pitch data. Accordingly, a low cost, high g, low resolution accelerometer 660 (FIG. 2) can be added to the sensor suite sensor to track the average pitch when the inground tool is rotating. In still another embodiment, a MEMS accelerometer can be used which has programmable g range such that the pitch range can be reprogrammed on-the-fly when conditions are warranted.

Figure 6:
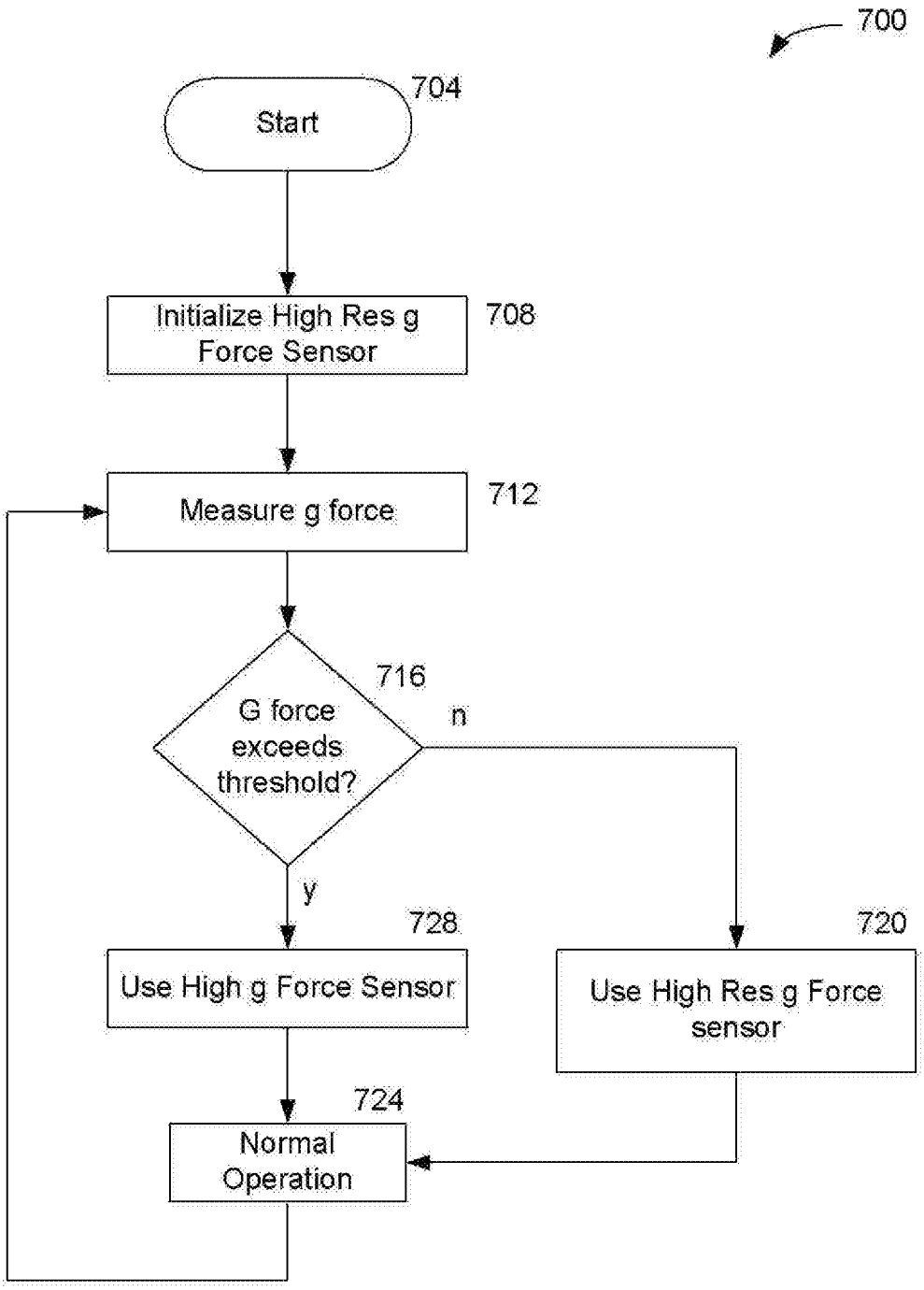
FIG. 6 is a flow diagram illustrating an embodiment of a method for dynamically customizing g force sensing to increase dynamic range based on operational conditions that are being encountered by an inground tool.

Turning now to FIG. 6 a flow diagram is presented illustrating one embodiment of a method, generally indicated by the reference number 700, for dynamically customizing g force sensing to increase dynamic range based on operational conditions that are being encountered by an inground tool. The method begins at 704 and proceeds to 708 which initializes sensing using a high-resolution, limited range g force sensor or a high resolution sensor range when a programmable sensor is used. At 712, a g force reading (i.e., accelerometer reading) is obtained. At 716, the reading is compared to a threshold value which can be based on the operational range capability of the accelerometer that is currently in use. If the current reading is within range, the method continues to use the high-resolution range at 720 and transmits the reading at 724 during normal operation. On the other hand, if step 716 detects that the current g force reading exceeds the threshold, operation proceeds to 728 to switch from the high-resolution sensor to a high g force, lower resolution sensor. Operation then proceeds to 724 such that pitch readings from the high-resolution sensor can be ensemble averaged for use by the system and/or presented to the operator of the portable device and/or drill rig. As part of normal operation, the procedure iteratively loops back to step 712 to obtain the next accelerometer reading.

The foregoing description of the invention has been presented for purposes of illustration and description. It is not intended to be exhaustive or to limit the invention to the precise form or forms disclosed, and other modifications and variations may be possible in light of the above teachings. For example, the data protocols described above can be selected manually or automatically. In one embodiment, one or more of the described advanced data protocols for producing extended range and/or providing immunity from interference can be selected from a portable locator, other above ground device or from the drill rig. In another embodiment, one or more of the described advanced data protocols can be selected based on the pitch orientation of a transmitter at start-up. In still another embodiment, one or more of the described advanced data protocols can be selected based on a drill string roll orientation sequence. Accordingly, those of skill in the art will recognize certain modifications, permutations, additions and sub-combinations of the embodiments described above.

What is claimed is:

1. An apparatus for use in conjunction with a system for performing an inground operation in which a drill string extends from a drill rig to an inground tool such that extension and retraction of the drill string generally produces corresponding movements of the inground tool during the inground operation, said apparatus comprising:

a transmitter configured to be carried proximate to the inground tool for sensing a plurality of operational parameters relating to the inground tool, for detecting whether an operational status of the inground tool is stationary or moving as well as changes in the operational status, and for transmitting a data signal characterizing one or more of the plurality of operational parameters at a higher level of resolution when the inground tool is stationary and at a lower level of resolution when the inground tool is moving wherein the transmitted data characterizing one or more of the plurality of operational parameters includes a static pitch resolution protocol and a dynamic pitch resolution protocol such that at least one of the dynamic pitch resolution protocol and the static pitch resolution protocol comprises representing a pitch orientation of the transmitter based on a resolution that decreases in one or more steps responsive to an increasing magnitude of the pitch orientation; and a receiver for positioning at an aboveground location for receiving the data signal and for recovering the plurality of operational parameters.

2. The apparatus of claim 1 wherein the transmitter is configured to determine the operational status of the inground tool as moving based on detecting at least one of movement and rotation of the inground tool.

3. The apparatus of claim 1 wherein the static pitch resolution protocol is higher in resolution than the dynamic pitch resolution protocol.

4. The apparatus of claim 1 wherein the static pitch resolution protocol characterizes the pitch orientation based on a fixed number of bits that defines a fixed number of bit values and said steps define at least two pitch ranges with said bit values assigned to the pitch ranges to establish the resolution for each pitch range.

5. The apparatus of claim 1 wherein the transmitter is configured to switch to a fixed length packet, responsive to detecting that the inground tool is stationary, to characterize one or more of the plurality of operational parameters and, thereafter, repeatedly transmit the fixed length packet during the stationary state for reception by the receiver.

6. The apparatus of claim 5 wherein the transmitter is further configured to include at least one of a roll orientation, a pitch orientation, a battery status and a temperature of the transmitter as the characterized one or more of the plurality of operational parameters in the fixed packet length.

7. The apparatus of claim 1 wherein the plurality of operational parameters includes a roll orientation of the transmitter and the transmitter is configured to transmit a roll orientation packet that specifies the roll orientation when the inground tool is rotating and to suspend transmission of the roll orientation packet when the inground tool is not rotating.

8. The apparatus of claim 1 wherein one of said plurality of operational parameters is a pitch orientation of the inground tool and said transmitter is configured to transmit a low resolution pitch packet responsive to detecting that the inground tool is moving and a high resolution pitch packet responsive to detecting that the inground tool is stationary.

9. An apparatus for use in conjunction with a system for performing an inground operation in which a drill string extends from a drill rig to an inground tool such that extension and retraction of the drill string generally produces corresponding movements of the inground tool during the inground operation, said apparatus comprising:

a transmitter configured to be carried proximate to the inground tool for sensing a plurality of operational parameters relating to the inground tool, for detecting whether an operational status of the inground tool is stationary or moving as well as changes in the operational status, and for transmitting a data signal characterizing one or more of the plurality of operational parameters at a higher level of resolution when the inground tool is stationary and at a lower level of resolution when the inground tool is moving wherein the transmitter is configured to detect a stationary state thereof and, responsive thereto, switch to a fixed length packet to characterize one or more of the plurality of operational parameters and, thereafter, repeatedly transmit the fixed length packet during the stationary state for reception by the receiver, and a receiver for positioning at an aboveground location for receiving the data signal and for recovering the plurality of operational parameters wherein the receiver is configured to ensemble average a plurality of receptions of the fixed length packet to recover the characterized one or more of the plurality of the operational parameters.

10. An apparatus for use in conjunction with a system for performing an inground operation in which a drill string extends from a drill rig to an inground tool such that extension and retraction of the drill string generally produces corresponding movements of the inground tool during the inground operation, said apparatus comprising:

a transmitter configured to be carried proximate to the inground tool for sensing a plurality of operational parameters relating to the inground tool, for detecting whether an operational status of the inground tool is stationary or moving as well as changes in the operational status, and for transmitting a data signal characterizing one or more of the plurality of operational parameters at a higher level of resolution when the inground tool is stationary and at a lower level of resolution when the inground tool is moving; and a receiver for positioning at an aboveground location for receiving the data signal and for recovering the plurality of operational parameters wherein said data signal is configured based on a packet protocol for transferring a series of packets from the transmitter to the receiver to characterize the one or more of the plurality of operational parameters such that each packet includes at least two sync bits to serve in decoding each packet at the receiver while the sync bits simultaneously serve as a data bit in conjunction with other bits to characterize one or more of the operational parameters.

11. The apparatus of claim 10 wherein the characterized one or more of the plurality of operational parameters is a roll orientation of the inground tool.

12. A transmitter for use in conjunction with a receiver as part of a system for performing an inground operation in which a drill string extends from a drill rig to an inground tool which supports the transmitter such that extension and retraction of the drill string generally produces corresponding movements of the inground tool during the inground operation, said transmitter comprising:

at least one sensor for sensing one or more operational parameters relating to the inground tool; and a processor configured for transmitting data relating to the one or more operational parameters in a standard mode and in an alternative mode, such that the alternative mode characterizes at least a particular one of the operational parameters using a number of bits that is less than another number of bits that the particular one of the operational parameters is characterized by in the standard mode with the alternative mode representing the particular one of the operational parameters at a lower resolution than the standard mode, wherein the particular one of the operational parameters is a roll orientation of the inground tool and said transmitter is configured to transmit the data using a higher resolution roll packet in said standard mode and a lower resolution roll packet in the alternative mode such that the standard mode represents 24 roll positions while the alternative mode represents a number of roll positions that is less than 24.

13. A transmitter for use in conjunction with a receiver as part of a system for performing an inground operation in which a drill string extends from a drill rig to an inground tool which supports the transmitter such that extension and retraction of the drill string generally produces corresponding movements of the inground tool during the inground operation, said transmitter comprising:

at least one sensor for sensing one or more operational parameters relating to the inground tool; and a processor configured for transmitting data relating to the one or more operational parameters in a standard mode and in an alternative mode, such that the alternative mode characterizes at least a particular one of the operational parameters using a number of bits that is less than another number of bits that the particular one of the operational parameters is characterized by in the standard mode with the alternative mode representing the particular one of the operational parameters at a lower resolution than the standard mode, wherein the particular one of the operational parameters is a pitch orientation having a magnitude and in at least one of the standard mode and the alternative mode, responsive to the magnitude of the pitch orientation increasing, a resolution of the pitch orientation decreases in one or more steps.

14. An apparatus for use in conjunction with a system for performing an inground operation in which a drill string extends from a drill rig to an inground tool such that extension and retraction of the drill string generally produces corresponding movements of the inground tool during the inground operation, said apparatus comprising:

a transmitter configured to be carried proximate to the inground tool for sensing a plurality of operational parameters relating to the inground tool and for transmitting a data signal from the inground tool based on a packet protocol that transfers a series of packets from the transmitter to characterize the one or more operational parameters such that each packet includes at least two sync bits to serve in decoding each packet while the sync bits simultaneously serve as a data bit in conjunction with other bits to characterize one or more of the operational parameters; and a receiver for positioning at an aboveground location for receiving the data signal and for recovering the operational parameters.

* * * * *